United States Patent [19]

McCullough, Jr. et al.

[11] Patent Number: 4,837,076

[45] Date of Patent: Jun. 6, 1989

[54] CARBONACEOUS FIBERS WITH SPRING-LIKE REVERSIBLE DEFLECTION AND METHOD OF MANUFACTURE

[75] Inventors: Francis P. McCullough, Jr., Lake Jackson, Tex.; David M. Hall, Auburn, Ala.

[73] Assignee: The Dow Chemical Company, Midland, Mich.

[21] Appl. No.: 112,353

[22] Filed: Oct. 22, 1987

Related U.S. Application Data

[63] Continuation-in-part of Ser. No. 856,305, Apr. 28, 1986, abandoned, which is a continuation-in-part of Ser. No. 827,567, Feb. 10, 1985, abandoned, which is a continuation of Ser. No. 724,440, Apr. 18, 1985, abandoned.

[51] Int. Cl.[4] ..... D03D 3/00

[52] U.S. Cl. ..... 428/224; 264/29.2; 264/DIG. 40; 423/447.1; 423/447.2; 423/447.4; 423/447.6; 428/221; 428/222; 428/288; 428/371; 428/408; 428/903

[58] Field of Search ..... 264/29.2, DIG. 40; 423/447.1, 447.2, 447.4, 447.6; 428/221, 222, 367, 369, 371, 377, 408

[56] References Cited

U.S. PATENT DOCUMENTS

| | | | |
|---|---|---|---|
| 4,412,675 | 11/1983 | Kawakubo | 423/449 |
| 4,631,118 | 12/1986 | McCullough et al. | 204/16 |
| 4,643,931 | 2/1987 | McCullough, Jr. et al. | 428/97 |

OTHER PUBLICATIONS

U.S. patent application Ser. No. 856,305, McCullough, Jr. et al., Carbonaceous Fibers with Spring-Like Reversible Deflection and Method of Manufacture, filed Apr. 16, 1986.

U.S. patent application Ser. No. 3,973, McCullough, Jr. et al., Improved Method and Materials for Manufacture of Antistatic Carpet and Backing, filed Jan. 16, 1987.

U.S. patent application Ser. No. 918,738, McCullough, Jr. et al., Thermal Insulation, filed Oct. 14, 1986.

U.S. patent application Ser. No. 558,239, McCullough, Jr. et al., Energy Storage Device, filed Dec. 5, 1983.

U.S. patent application Ser. No. 678,186, McCullough, Jr. et al., Secondary Electrical Energy Storage Device and Electrode Therefor, filed Dec. 4, 1984.

U.S. patent application Ser. No. 4,003, McCullough, Jr. et al., Molten Lithium Solid Membrane Electrolyte Battery, filed Jan. 1, 1986.

U.S. patent application Ser. No. 3,974, McCullough, Jr. et al., Molten Lithium Solid Membrane Electrolyte Battery, filed Jan. 16, 1987.

U.S. patent application Ser. No. 741,320, McCullough et al., Improved Secondary Battery, filed Jun. 4, 1985.

*Primary Examiner*—James J. Bell

*Attorney, Agent, or Firm*—John Lezdey; Joe R. Prieto

[57] ABSTRACT

The invention provides a non-flammable non-linear elongatable carbonaceous fiber having a reversible deflection of greater than 1.2:1 and an aspect ratio of greater than 10:1 which may be formed into a resilient structure and the method of preparing said fiber.

27 Claims, No Drawings

CARBONACEOUS FIBERS WITH SPRING-LIKE REVERSIBLE DEFLECTION AND METHOD OF MANUFACTURE

CROSS REFERENCE TO RELATED APPLICATIONS

This application is a continuation-in-part of our copending application Ser. No. 856,305 filed Apr. 28, 1986 abandoned which is a continuation-in-part of application Ser. No. 827,567, filed Feb. 10, 1985 now abandoned, which is a continuation of earlier filed application Ser. No. 724,440 filed Apr. 18, 1985 abandoned, each entitled "Carbonaceous Fibers with Spring-Like Reversible Deflection and Method of Manufacture" of McCullough, et al.

FIELD OF THE INVENTION

The invention resides in a resilient structure of a non-flammable carbonaceous fiber or fiber assembly derived from stabilized polymeric precursor fibers having imparted thereto a non-linear configuration capable of reversible deflection of greater than about 1.2 times the length of the non-linear structure when in a relaxed or unstressed condition. More particularly, the non-linear carbonaceous fibers of the present invention are formed into permanent lightweight resilient compressible structures having good shape and volume retention that are stable to numerous compression and unloading cycles without significant breakage of the fibers.

BACKGROUND OF THE INVENTION

The prior art has prepared filaments from pitch based (petroleum and/or coal tar) compositions by the conventional technique of melt spinning into fibers or filaments which can be converted into multi-filament assemblies and thereafter oxidatively stabilized. Such fibers or assemblies are taught to be useful per se or the filaments or assembly of filaments may be chopped or the fibers may be stretch broken into what the art refers to as a "staple" fiber. Such "staple" thereafter may be converted by drafting, drawing and/or twisting, referred to as spinning in the industry, the chopped filaments (staple fibers) into a yarn. The continuous filaments are made into tows formed from a plurality of the continuous mono-filaments. The resulting yarns or threads are used per se or may be woven into cloth-like articles and used as such. Alternatively, a woven cloth-like article may be carbonized to produce a graphite or graphite-like cloth. In addition, a fiber tow per se, without weaving, may be carbonized and thereafter used as a reinforcement material for synthetic resinous materials e.g., "pre-preg", and the like.

In a somewhat similar manner polyacrylonitrile has been wet spun into filaments, assembled into filament tows, stabilized by oxidation and the tows made into staple by chopping or stretch breaking. The staple is then spun into yarn, the yarn is knit or woven into a cloth or fabric, and, if desired, the resulting fabric carbonized at a temperature of greater than 1400 degrees. These materials, in their precarbonized woven state, have been used as non-combustible reinforcing materials for metallized fire fighting suits. These materials, in their unwoven carbonized form, have been used as a reinforcement material for synthetic resinous composites.

In preparing uncarbonized conventional polymeric textile yarns for knitting, weaving or other textile manufacture it is the usual practice in the industry to pinch crimp the yarn and thus crimp-set the individual fibers of the yarn (placing sharp acute bends in the fiber). Such textile treatment methods provide the same effect if used on a carbonaceous yarn, i.e., severe sharp crimps are applied to the yarn causing entanglement among the individual fibers of the yarn and thus assisting in maintaining or fixing the fibers in the yarn as well as to impart bulk properties to the yarn. However, when the procedure for the manufacture of ordinary textile yarn is followed and a carbonizable precursor yarn is crimped then carbonized, usually at a temperature above about 1000 degrees C. and more practically at temperatures of 1400 degrees C. and above, the resulting yarn (the filaments and/or fibers) becomes very brittle. That is to say, the yarn cannot be harshly handled or sharply creased, unwoven, garnetted, deknitted or carded without breaking the fibers in the yarn into small segments. As a result of such brittleness, a knitted fabric cannot be deknitted without special care and such deknitted yarn cannot be carded to convert the fibers in the yarn into a wool-like fluff without causing a severe destruction, i.e. breakage, of the fibers.

The prior art generally discloses linear carbonaceous filaments having a high tensile strength or a high surface area. The manufacture of such filaments of alleged "graphitic" nature have necessitated the utilization of high temperatures to obtain a high degree of carbonization. However, the filaments produced from such a high temperature treatment are very brittle and incapable of standing up to stress such as a repeated bending of the filaments, particularly when they have been subjected to a temperature above about 1000 degrees C. particularly at about 1400 degrees C. Exemplary of a high temperature treatment of filaments derived from stabilized mesophase pitch is found in U.S. Pat. No. 4,005,183 where the fibers are stabilized and made into a yarn having a low (below normal absorptive carbon) surface area and a Young's modulus within the range of from 1 to 55 million psi.

Another technique for making a fabric panel is described in U.S. Pat. No. 4,341,830 in which a tow of acrylic filaments is oxidized under tension, at a temperature of from 200 degrees to 300 degrees C., crimped in a stuffer box, made into staple fibers and spun into a yarn which is then knitted into a cloth panel and heat treated, i.e. carbonized, in an inert atmosphere at a temperature of up to 1400 degrees C. The so carbonized cloth panels are assembled into a stack and the stack placed into a carbon vapor furnace for deposition of carbon onto and into the stack. This treatment is carried out by passing a carbonaceous gas, methane, through the stack while inductively heating the stack to 2000 degrees C. to cause carbon to be deposited onto and into the stack and produce a carbonaceous body having a matrix of panels. The yarn made by this process has been found to be very brittle, and cannot be subjected to repeated acute angle stress bending, as would occur if the cloth panel were deknitted, without a severe breakage of the fibers in the cloth.

U.S. Pat. No. 4,193,252 to Sheppherd, et al discloses the making of partially carbonized, graphite and carbon fibers from rayon which have been knitted into a carbon assembly. When the fabric is deknitted, the partially carbonized and the carbonized fibers contain kinks. The fully carbonized or graphite fibers have kinks which are more permanent in nature. Applicants have found that partially carbonized rayon fibers are flammable, do not retain their reversible deflection and lose their kinds at relatively low temperatures or under tension. The fully carbonized or graphite yarn which is prepared from rayon is brittle and difficult to handle when deknitting. Moreover, carbon fibers produced from rayon are known to posses higher water absorption and their tendency to recover from compression is poor. If a mat of these fibers is laid down and thereafter placed under a compressive force, the mat will not re-expand to its original loft.

The term "stabilized" herein applies to fibers or tows which have been oxidized at a specific temperature, typically less than about 250 degrees C. for PAN fibers, provided it is understood that in some instances the filament and or fibers are oxidized by chemical oxidants at lower temperatures.

The term "Reversible Deflection" or "Working Deflection" is used herein as it applies to a helical or sinusoidal compression spring. Particular reference is made to the publication "*Mechanical Design - Theory and Practice*", MacMillan Publ. Co., 1975, pp 719 to 748; particularly Section 14-2 pages 721–24.

SUMMARY OF THE INVENTION

In accordance with the present invention there is provided a non-flammable non-linear elongatable carbonaceous fiber having a reversible deflection ratio of greater than 1.2:1, preferably greater than 2.0:1 and an aspect ratio (l/d) greater than 10:1.

In accordance with one embodiment of the invention, there is provided a fiber having a specific resistivity of less than $10^{10}$ ohm-cm, a density of less than 2.5 gm/cc, a Young's modulus of from 6.9 GPa to 380 GPa, and a surface area of less than $15m^2/gm$.

In accordance with another embodiment of the invention, there is provided a wool-like fluff prepared from the fibers of the invention. Advantageously, a fluff is prepared from fibers having a specific resistivity of less than 75 ohms at a probe distance of less than 60 cm where measured across the wool-like fluff.

In accordance with a further embodiment of the invention, the fibers are prepared from a carbonaceous fiber, yarn or tow of oxidation stabilized precursor materials. The precursor materials may comprise acrylic filaments, pitch based (petroleum or coal tar) filaments polyacetylene or other polymeric materials. The precursor fibers may be formed by any conventional method i.e. melt or wet spinning a fiber to a nominal diameter of from 10 to 20 micrometers which is then stabilized by oxidation in a known manner. The fibers may have a temporary set coil-like or sinusoidal configuration when heated below 525 degrees C. A permanent set is imparted when heated at least at a temperature and a period of time as will hereinafter be described whereby both the chemical and physical characteristics are changed. The heating temperatures, as will be hereinafter discussed, will provide the fibers with different degrees of electrical conductivity.

DESCRIPTION OF THE PREFERRED EMBODIMENTS

The invention comprises non-linear nonflammable resilient elongatable carbonaceous fibers or assembly of fibers having a reversible deflection ratio of greater than about 1.2:1 and an aspect ratio of greater than 10:1. The carbonaceous fibers may posses a sinusoidal or a coil-like configuration or a more complicated structural combination of the two.

The fibers of the invention according to the test method of ASTM D 2863-77 have a LOI value greater than 40. The test method is also known as "oxygen index" or "limited oxygen index" (LOI). With this procedure the concentration of oxygen in $O_2/N_2$ mixtures is determined at which the vertically mounted specimen-ignited at its upper end just continues to burn. The size of the specimen is 0.65–0.3 cm with a length from 7 to 15 cm. The LOI value is calculated according to the equation:

$$LOI = \frac{[O_2]}{[O_2] + [N_2]} \times 100$$

The LOI value of a number of fibers is as follows:

| | |
|---|---|
| polypropylene | 17.4 |
| polyethylene | 17.4 |
| polystyrene | 18.1 |
| rayon | 18.6 |
| cotton | 20.1 |
| nylon | 20.1 |
| polycarbonate | 22 |
| rigid polyvinyl chloride | 40 |
| oxidized polyacrylonitrile | >40 |
| graphite | 55 |

Such carbonaceous fibers are prepared by heat treating a suitable stabilized precursor material such as that derived from stabilized polyacrylonitrile based materials or pitch base (petroleum or coal tar) or other polymeric materials which can be made into a non-linear fiber or filament structures or configurations. The fibers have a carbon content at least about 65%.

For example, in the case of polyacrylonitrile (PAN) based fiber, the fibers are formed by melt or wet spinning a suitable fluid of the precursor material into a fiber having a normal nominal diameter of from about 4 to 25 micrometers. The fiber is collected as an assembly of a multipicity of continuous filaments in tows which are stabilized (by oxidation in the case of PAN based fibers) in the conventional manner. The stabilized tows (or staple yarn made from chopped or stretch broken fiber staple) are thereafter, in accordance with the present invention, formed into a coil-like and/or sinusoidal form by knitting the tow or yarn into a fabric or cloth (recognizing that other fabric forming and coil forming methods can be employed). The so-formed knitted fabric or cloth is thereafter heat treated, in a relaxed and unstressed condition, at a temperature of from about 525 degrees C. and about 750 degrees C., in an insert atmosphere for a period of time to product a heat induced thermoset reaction wherein additional crosslinking and/or a cross-chain cyclization reaction occurs between the original polymer chain. At the lower temperature range of from 150 degrees C. to about 525 degrees C., the fibers are provided with a varying proportion of temporary to permanent set while in the upper range of temperature of from 525 degrees C. and above, the fibers are provided with a permanent set. It is of course to be understood that the fiber or fiber assembly may be initially heat treated at the higher range of temperatures so long as the heat treatment is conducted while the coil-like and/or sinusoidal configuration is in a relaxed or unstressed state and under an inert, non-oxidizing atmosphere. As a result of the higher temperature treatment, a permanently set coil-like or sinusoidal configuration or structure is imparted to the fibers in yarn, tow or threads. The resulting fibers, tows or yarns having the non-linear structural configuration, which are derived by deknitting the cloth, or even the cloth per se, are subjected to other methods of treatment known in the art to create an opening, a procedure in which the yarn, tow or the fibers or filaments of the cloth are separated into a non-linear entangled wool-like fluffy material in which the individual fibers retain their coil-like or sinusoidal configuration yielding a fluff or batting-like body of considerable loft.

The stabilized fibers when permanently configured in accordance with the present invention into the desired non-linear structural configuration. e.g., by knitting, and thereafter heating at a temperature of greater than about 550 degrees C., retain their resilient and reversible deflection characteristics. It is to be understood that higher temperatures may be employed up to 1500 degrees C. or higher, but the most flexible and least loss of fiber length, when carded to produce the fluff, is found in those fibers and/or filaments heat treated to between about 525 and 750 degrees C.

The carbonaceous material of the invention may be classified into three groups depending upon the particular use and the environment that the structures in which they are incorporated are placed.

In a first group, the non-linear non-flammable carbonaceous fibers are non-electrically conductive and possess no substantial anti-static characteristics.

The term non-electrically conductive as utilized in the present application relates to a resistance of greater than $10^7$ ohms per inch on a 6K tow formed from precursor fibers having a diameter of 10–12 microns.

When the precursor fiber is an acrylic fiber it has been found that a nitrogen content of 18.8% or more results in a non-conductive fiber.

In a second group, the non-flammable non-linear carbonaceous fibers are classified as having low electrically conductive and have a carbon content of less than 85%. Low conductivity means that the fibers have a resistance of about $10^7$–$10^4$ ohms per inch. When the precursor stabilized fiber is an acrylic fiber, i.e., a polyacrylonitrile based fiber, the percentage nitrogen content is from about 18 to 18.8% for the copolymer and up to about as high as 35% for the terpolymer, preferably, about 18.5%. The structures formed therefrom are lightweight, have low moisture absorbency, good abrasive strength together with good appearance and handle.

In a third group are the fibers having a carbon content of at least 85%. The fibers as a result of their high carbon content have superior thermal insulating and sound absorbing characteristics. The coil-like structure in the form of a fluff (or when carded) has good compressibility and resiliency. These fibers are characterized as being highly conductive. That is, the resistance is less 10 ohms per inch.

The precursor stabilized acrylic filaments which are advantageously utilized in preparing the fibers of the structures are selected from the group consisting of acrylonitrile homopolymers, acrylonitrile copolymers and acrylonitrile terpolymers.

The copolymers and terpolymers preferably contain at least about 85 mole percent of acrylic units, preferably acrylonitrile units, and up to 15 mole percent of one or more monovinyl units copolymerized with styrene, methylacrylate, methyl methacrylate, vinyl chloride, vinylidene chloride, vinyl pyridine, and the like. Also, the acrylic filaments may comprise terpolymers, preferably, wherein the acrylonitrile units are at least about 85 mole percent.

It is to be further understood that carbonaceous precursor starting materials may have imparted to them an electrically conductive property on the order of that of metallic conductors by heating the fiber fluff or the batting like shaped material to a temperature above about 1000 degrees C. in a non-oxidizing atmosphere. The electroconductive property may be obtained from selected starting materials such as pitch (petroleum or coal tar), polyacetylene, acrylonitrile based materials, e.g., a polyacrylonitrile copolymer (PANOX or GRAFIL-01), polyphenylene, SARAN* resin (*trademark of The Dow Chemical Company) and the like.

Preferred precursor materials are prepared by melt spinning or wet spinning the precursor materials in a known manner to yield a monofilament or multi-filament fiber tow and the fibers or filaments yarn, tow, woven cloth or fabric or knitted cloth by any of a number of commercially available techniques, heating the resulting material, preferably to a temperature above about 525 degrees C. and thereafter deknitting and carding the material to produce the fluff which may be laid up in batting-like form.

Exemplary of the products which can be structures of the present invention are set forth in the following examples:

EXAMPLE 1

A stabilized polyacrylonitrile PANOX (R.K. Textiles) continuous 3K or 6K, hereinafter preferred to as OPF, tow having nominal single fiber diameters of 12 micrometer, was knit on a flat bed knitting machine into a cloth having from 3 to 4 loops per centimeter. Portions of this cloth were heat set at one of the temperatures set forth in Table I over a 6 hour period. When the cloth was deknitted, it produced a tow which had an elongation or reversible deflection ratio of greater than 2:1. The deknitted tow was cut into various lengths of from 5 to 25 cm, and fed into a Platts Shirley Analyzer. The fibers of the tow were separated by a carding treatment into a wool-like fluff, that is, the resulting product resembled an entangled wool-like mass or fluff in which the fibers had a high interstitial spacing and a high degree of interlocking as a result of the coiled and spring-like configuration of the fibers. The fiber lengths of each such treatment were measured and the results of these measurements set forth in Table 1.

TABLE I

| Run # | Fiber Staple Length (cm) | Heat Treatment degrees C. | Stitches/ (cm) | Tow Size |
|---|---|---|---|---|
| 1 | 15 | 550 | 4 | 3K |
| 2 | 5 | 550 | 4 | 3K |
| 3 | 10 | 650 | 3 | 6K |
| 4 | 10 | 950 | 3 | 6K |
| 5 | 20 | 750 | 3 | 6K |
| 6 | 25 | 950 | 4 | 6K |

| Run # | Range of Fiber Lengths (cm) | Length of Majority of Fibers (cm) |
|---|---|---|
| 1 | 3.8–15 | 13–15 |
| 2 | 2.5–5 | 2.5–5 |
| 3 | 5.0–10 | 7.5–10 |
| 4 | 3.8–9.5 | 7.5–9.5 |
| 5 | 7.5–19 | 15.0–19 |

TABLE I-continued

| | |
|---|---|
| 6 | 7.5–23 |

EXAMPLE 2

A series of runs were made to determine the effect various heat treatment temperatures had on the fibers. A significant property was the specific resistivity of the fibers. To determine such property numerous samples of an oxidation stabilized polyacrylonitrile (density 1.35 to 1.38 g/cc) yarn having either 3000 or 6000 filaments per tow, manufactured by RK Textiles of Heaton-Noris, Stockport, England, hereafter referred to as Panox 3K or 6K, having from 3 to 4 stitches per cm, respectively. The cloth was placed in an oxygen free nitrogen pad in a quartz-tube furnace capable of incremental heating. The temperature of the furnace was gradually increased from room temperature to about 550 degrees C. over a three hour period with the higher temperatures being achieved by 50 degrees C. increments every 10–15 minutes. The material was held at the desired temperature for about 1 hour, the furnace opened and allowed to cool while purging with argon. Representative of the furnace temperatures at the above present incremental temperature schedule is that for a 6k yarn and shown in Table II following:

TABLE II

| Time | Temp. Degrees C. |
|---|---|
| 0720 | 200 |
| 0810 | 270 |
| 0820 | 300 |
| 0830 | 320 |
| 0840 | 340 |
| 0850 | 360 |
| 0900 | 370 |
| 0950 | 380 |
| 0935 | 420 |
| 0950 | 450 |
| 1005 | 500 |
| 1010 | 550 |
| 1025 | 590 |
| 1035 | 650 |
| 1045 | 600 |
| 1100 | 750 |
| 1400 | 750 |

The specific resistivity of the fibers was calculated from measurements made on each sample using a measured average of six measurements, one made from fibers removed at each corner of the sample and one made from fibers removed from each edge, approximately at the middle of the sample. The results are set forth in Table III following:

TABLE III

| Final Temp. in degrees C. | % wt. loss | Log Specific Resistivity Measured in ohm cm |
|---|---|---|
| 500 | — | 4.849 |
| 550 | 33 | — |
| 600 | — | 2.010 |
| 650 | 34 | — |
| 750 | 37 | −1.21 |
| 850 | 38 | −2.02 |
| 900 | 42 | −2.54 |
| 950 | 45 | −2.84 |
| 1000 | 48 | −3.026 |
| 1800 | 51 | −3.295 |

All of the above fibers had cm LOI greater than 40 and an aspect ratio greater than 10:1.

The analysis of the heat treated fibers was as follows:

| Temperature (degrees C.) | % C | % N | % H |
|---|---|---|---|
| ambient (OPF) | 58.1 | 19.6 | 3.8 |
| 450 | 66.8 | 19.4 | 2.2 |
| 550 | 69.9 | 18.9 | 1.9 |
| 650 | 69.7 | 18.1 | 1.6 |
| 750 | 73.0 | 17.8 | 1.1 |

EXAMPLE 3

A fabric was knitted from a 3K or 6K PANOX OPF (R.K. Textiles) continuous stabilized filament tow on a Singer flat bed knitting machine and heat treated at the temperatures until thermoset set forth in Table IV. The fabric was then deknitted and the configured tow fed directly into a carding machine. The resulting wool-like mass was collected onto a rotating drum and had sufficient integrity to enable it to be easily handled.

The fiber treated at a temperature of 550 degrees C is particularly suitable as insulation for clothing such as parkas, sleeping blankets, etc because of its hand. The fluff can also be used to insulate structures for sound and against extreme temperature.

The fiber treated at a temperature of 650 degrees C. can be used as insulation for installations such as machinery and engines.

In Table IV the length of the fibers ranged from 2 to 15 cm. A wool-like mass treated at a temperature of 950 degrees C. was highly conductive and had a resistance of less than 75 ohms at any probe length taken at widely separated distances (up to 60 cm) in the wool-like mass. The experiment illustrates that the high temperatures of heating the fiber results in reduction of the fiber diameter.

TABLE IV

| Run # | Fiber Staple Length (cm) | Heat Treatment degrees C. | Stitches/cm |
|---|---|---|---|
| 1 | 7.5 | 550 | 4 |
| 2 | 10 | 650 | 3 |
| 3 | 15 | 650 | 3 |
| 4 | 20 | 950 | 3 |
| 5 | 25 | 950 | 3 |

| Run # | Tow Size | Range of Fibers Lengths (cm) |
|---|---|---|
| 1 | 3K | 2.5–7.5 |
| 2 | 6K | 2.5–10 |
| 3 | 6K | 2.5–13.3 |
| 4 | 6K | 2–15.0 |
| 5 | 6K | 2–12.5 |

EXAMPLE 4

A 3K OPF (i.e., 3000 filaments) PANOX stabilized tow was knit on a Singer flat bed knitting machine at a rate of 4 stitches/cm and was then heat treated at a temperature of 950 degrees C. The cloth was deknitted and the tow (which had a elongation or reversible deflection ratio of greater than 2:1) was cut into 7.5 cm lengths. The cut yarn was then carded on a Platt Miniature carding machine to produce a wool-like fluff having fibers ranging from 2.5 to 6.5 cm in length. The wool-like fluff had a high electrical conductivity over any length of up to 60 cm tested.

In lieu of PANOX, there may be employed stabilized pitch based fibers or a copolymer or terpolymer of polyacrylonitrile.

EXAMPLE 5

In a similar manner to Example 4, a portion from the same knit sock was heat treated at a temperature of 1550 degrees C. The cloth itself and the deknitted tow had a very high electrical conductivity. On carding 15 cm lengths of cut tow, a fluff containing fibers was obtained which had fibers of lengths 2.54 to 9.5 cm (1 to 3 inches) with average lengths of 5 cm (2 inches). Thus, carding of a deknitting continuous filament tow knitted fabric which has been subjected to a temperature of above about 1000 degrees C. is still capable of producing a wool-like fluff product.

EXAMPLE 6

The material of Example 3, which had been heat treated to 550 degrees C. until thermoset, possessed very low electrical conductivity. The material was fabricated into a thermal jacket employing about 5 ounces (0.14 kg) of the fluff as the sole fill of the jacket. The jacket had an insulating effect similar to that of a down jacket having 15–25 ounces (0.42–0.71 kg) of down as the insulating fill. If desired, the fibers may be blended with other synthetic fibers such as nylon, rayon or polyester.

EXAMPLE 7

A 3K OPF tow was knit into a sock, the sock treated at 525 degrees C. until it was thermally set and thereafter deknit and cut into about 7–7½ (17.78 –19.05 cm) inch nominal lengths. The so cut yarns were opened on a Shirley opener than further processed on a Rando Webber machine, an air laying system for producing non-woven batting. The feed plate-combing roll were spaced at 12/1000 inch and dispersed into the chamber using a 1200 rpm setting on the fan. A small amount of low melting fibers of ethylene acrylic acid copolymer (manufactured from PRIMACOR* 440 resin trademark of *The Dow Chemical Company), were blended with the cut treated OPF tow fibers as it was fed into the Shirley. The resulting batting was passed through a Benz hot air oven held at 260 degrees C. at a rate of 2 m/min resulting in an oven time of about 1 minute. This was sufficient to melt the polyethylene acrylic acid thereby to achieve a light bonding of the carbonaceous fibers in the web.

EXAMPLE 8

To establish the heat conductivity of the carbon fibers per se two samples of a fluff prepared in the manner of Example 6, 8×8 inches square and about 3 inches (7.62 cm) high, one, Sample 1, weighting about 43 grams and the other, Sample 2, about 52 grams were compressed to 1.15 and 0.85 inches, respectively, and the R-value and the K-value were measured using ASTM-C-518 method with a 100 degrees F hotplate and a 50 degrees F cold plate. The results were as follows:

| Sample | Compressed Thickness (in.) | R-Value Hr-ft$^2$ degrees F/BTU | K-Value BTU/Hr-ft$^2$-degrees |
|---|---|---|---|
| 1 | 1.15 | 4.11 | 0.28 |
| 2 | 0.85 | 4.03 | 0.21 |

Sample 1 had been treated to 950 degrees C. and Sample 2 had been heated to 550 degrees C.

EXAMPLE 9

A Monsanto 1879 nylon (trilobal) staple was blended with 0.5 percent by weight of a conductive fiber prepared in accordance with the present invention. The conductive fiber was prepared by heating an oxidatively stabilized polyacrylonitrile multi-filament fiber tow which had been knitted into a cloth, heat-set at about 1500 degrees C., de-knitted and cut into staple approximately 18 cm in length. The blended staple was carded and the resulting sliver was pin drafted three times. Recombination ratios were 10:1, 3:1 and 5:1, respectively. The resulting drafted sliver was spun into a single ply yarn with an average twist of about 4.75. The majority of the carbonaceous fiber was broken into lengths much smaller than the original 18 cm lengths, typically 3.5 cm or less, resulting in a large loss of carbonaceous fiber from that originally included in the singles spinning process. The resulting carbonaceous fiber containing singles yarn was plied with a nylon yarn made in the same fashion but containing no carbonaceous fiber. The 3.00/2 ply yarn which was heat set on a Suessen heat setting apparatus was thereafter tufted into a ⅛ gauge, 84 gm, 9.5 mm pile height carpet (a cut loop form) with approximately 3 stitches per cm. The ratio of carbonaceous fiber to yarn containing no carbonaceous yarn in the tufting operation was 1:5, respectively. A portion of the carpet was backed with a commercial non-conductive latex carpet backing. The resulting carpet when tested for static discharge properties by charging the carpet to 5000 volts while in an atmosphere having a relative humidity of less than 20 percent. The static charge was dissipated to 0 percent of original charge in less than one second, and some of the sample discharged in less than 1/2 second. The standard for the industry is a discharge to 0 percent in 2 seconds or less. This example illustrates that other than polyacrylonitrile based filaments can be employed in accordance with the present invention and that temperatures above about 1000 degrees C. can be employed in heat-setting the sinusoidal structure into the yarn, but that at temperatures above 1000 degrees C. much embrittlement occurs and the fibers resulting were inefficiently used, being lost as short fibers not being incorporated into the yarn when drafted with normal carpet staple to prepare singles.

EXAMPLE 10

In another example 100 grams of the same precursor acrylonitrile fiber tow as described in Example 9 was used. However, the precursor fiber was heat set after knitting at a temperature of only 950 degrees C. All other aspects of the carbonaceous material was the same. The carbonized fiber was blended with 45.3 kg of the Monsanto 1879 nylon staple as in Example 7. The resulting yarn contained 0.02 percent carbonized fibers which were substantially evenly distributed throughout the yarn. The yarn was tufted to prepare a carpet in a similar manner to Example 9. Thus, each tufted end has the carbonized fibers. Results were similar to the results obtained in Example 9.

Knitted yarn or fiber tows which have been heat treated to a temperature above 1000 degrees C., and thus been rendered electrically conductive, have found special utility in the manufacture of electrodes for a non-aqueous secondary energy storage device such as described in a copending U.S. Application Ser. No. 558,239 filed Dec. 5, 1983, entitled ENERGY STORAGE DEVICE by F.P. McCullough and A.F. Beale, Jr., as well as application Ser. No. 678,186 filed Dec. 4, 1984, entitled SECONDARY ELECTRICAL ENERGY STORAGE DEVICE AND ELECTRODE THEREFOR

EXAMPLE 11

In another experiment tows made by deknitting a flat stock cloth in which the tow was a stabilized polyacrylonitrile precursor of the indicated filament count which had been heat-set at the indicated temperatures prior to deknitting. Tow lengths were measured for resilient deflection by adding known weights to the tow portion and the intermediate and final deformation, as well as the final non-resilient elongation measured. The results are set forth in Table V.

TABLE V

| Sample Description | Heat Treatment degrees C. | Relaxed Length (mm) | Weight Added (gm) | Elongation (mm) |
|---|---|---|---|---|
| A. Panox 6K tow with 1.1 twists/in. as plain jersey w/8–10 picks/ | 650 | 106 | 0 | 0 |
| | | | 0.275 | 16 |
| | | | 0.901 | 54 |
| | | | 1.526 | 83 |
| | | | 2.017 | 99 |
| | | | 2.468 | 110 |
| | | | 2.943 | 119 |
| | | | St.* | 216 |
| | | | 0 | 0** |
| b. Panox K tow w/ no twist, plain jersey knit w/10–12 picks/in. | 650 | 92 | 0 | 0 |
| | | | 0.275 | 33 |
| | | | 0.901 | 101 |
| | | | 1.526 | 140 |
| | | | 2.017 | 163 |
| | | | 2.468 | 172 |
| | | | 2.943 | 186 |
| | | | St.* | 256 |
| | | | 0 | 6** |
| c. Hysol-Grafil-01 6K tow w/no twist knitted as Interlock w/8 picks/in. | 650 | 122 | 0 | 0 |
| | | | 0.275 | 25 |
| | | | 0.901 | 75 |
| | | | 1.526 | 87 |
| | | | 2.017 | 116 |
| | | | 2.468 | 128 |
| | | | 2.943 | 133 |
| | | | St.* | 208 |
| | | | 0 | 1** |
| d. Hysol-Grafil-01 knit as Interlock with 8 picks/in. | 650 | 107 | same weights as previously setforth | 0 |
| | | | | 31 |
| | | | | 71 |
| | | | | 98 |
| | | | | 105 |
| | | | | 115 |
| | | | | 119 |
| | | | | 187 |
| | | | | 0* |
| e. Panox 6K tow w/1.1 twists/in. knit as plain jersey w/8–10 picks/in. | 170 | 137 | same as previous schedule | 0 |
| | | | | 38 |
| | | | | 69 |
| | | | | 66 |
| | | | | 66 |
| | | | | 61 |
| | | | | 60 |
| | | | | 98 |
| | | | | 49* |
| f. Panox 6K tow w 1.1 twists in. knit as plain jersey w/8–10 picks/in. | 300 | 145 | same as previous schedule | 0 |
| | | | | 55 |
| | | | | 111 |
| | | | | 116 |
| | | | | 115 |
| | | | | 116 |
| | | | | 118 |
| | | | | 125 |
| | | | | 25* |
| g. Panox 6K tow/1.1 twists /in., knit as plain jersey w/ 8–10 picks/ in. | 525 | 109 | same as previous schedule | 0 |
| | | | | 51 |
| | | | | 131 |
| | | | | 167 |
| | | | | 187 |
| | | | | 196 |
| | | | | 201 |
| | | | | 249 |
| | | | | 14* |

*St. = Structure straightened by hand to ultimate linear length.
**Weight removed and Sample permitted to return to its relaxed state.

EXAMPLE 11

To illustrate the effect of tension on the fibers or filaments during setting of the spring-like configuration. A 6K tow of Panox continuous fibers was roll-wrapped onto a 5/16 inch quartz rod. The wound tow was heat treated according to the schedule as set forth in Example 2, Table III to a final temperature of 300 degrees C. while holding the ends of the wrapped tow secure. The heat treatment set a spring-like configuration into the tow, however, the fibers were very stiff and the tow was removed from the rod with difficulty. Many of the fibers broken on removal. This tow did not have the same spring-like resilience as tows heat set in a relaxed knitted configuration. If the same procedure is employed but the coiled tow is heated to 350 degrees C., much greater breakage occurs even before removal.

The latter procedure was repeated and the 350 degrees C. heat treated material after removal from the rod was heated while in a relaxed state slowly to about 650 degrees C. to determine whether any annealing would occur. None did. The resultant coil was brittle and had no resiliency. However, if the wrapped coiled tow was removed from the rod prior to reaching 275 degrees C and a smaller diameter rod was inserted to maintain the integrity of the coil shape, heating in this "relaxed" state would result in a coil or spring like tow having substantially the same properties as the aforedescribed deknitted tows and/or yarns.

EXAMPLE 12

A. Carbonaceous filaments from a rayon precursor

A 300 denier and a 1650 denier rayon continuous tow yarn was knitted into approximately two (2) inch (about 2.5 cm) diameter socks on a single end jerseystyle circular knitting machine. The socks were cut into four short sections. Three such sections from the sock knit from the 300 denier yarn tow were introduced, one at a time, into a tube furnace. In each instance the furnace was closed and purged with nitrogen for fifteen (15) minutes. Thereafter the furnace temperature was slowly raised from the first sock section to 370 degrees C. over a 1½ hour period, for the second sock section to 550 degrees C. over a 1¾hour period, and for the third sock section to 1050 degrees C. over a 1¼ hour period, respectively.

Each section taken from the furnace was black in color.

The first section which had been heated to 370 degrees C. , was very flexible, was substantially electrically nonconductive, the yarn tow was capable of careful hand deknitting, the deknit tow was of a sinusoidal configuration, the tow was capable of elongation to a straight length with little breakage of the individual fibers and the tow lost its sinusoidal configuration when heat was applied by blowing hot air from the heat gun (a hair dryer) thus indicating the "set" (sinusoidal or coilure configuration of the tow) was only temporary. Only minimal weight loss was observed as a result of the heat treatment procedure.

The second section which had been heated to 550 degrees C., was moderately flexible, was substantially electrically conductive having an electrical resistivity of $7\times10^9$ ohms per square, the tow was capable of careful hand deknitting but broken into short lengths of about 2.5 to 5 cm, the said pieces of deknit tow had a sinusoidal configuration but such pieces were not capable of reversible full elongation without breaking, that is the individual fibers of the deknit tow broke into short pieces even when the most gentle attempts were made to elongate the sinusoidal configuration of the two to anything approaching a straight configuration.

While the tow length of about 2.5 to 5 cm did not appear to lose their sinusoidal configuration when heat was applied, the fibers broke due to the force of the air from the heat gun, the yarn strands comprised of the bundle of short fibers were brittle and it was impossible, even when the most gentle conditions of handling were used, to separate the individual fibers of lengths greater than about 1 cm or less.

The third section, which had been heated to 1050 degrees C., was even less flexible than the previous section, had lost over 75% of its original dry weight, resulting in a marked decrease of fiber diameter, was substantially electrically conductive having an electrical resistivity of 70 ohms per square, a tow was not capable of being drawn from the knit fabric in its knitted state after heating, even by careful hand deknitting, the fibers breaking into short lenghts as the tow was drawn from the fabric.

On attempting to deknit the latter fabric, bundles of fibers of less than ½ inch (1.25 cm) long were objected which, while having a sinusoidal configuration, were not capable of elongation since the individual fibers broken into even smaller pieces.

B. Carbonaceous filaments according to the invention

The procedure of Part A was followed except that in lieu of rayon the sock was prepared from an oxidation stabilized polyacrylonitrile (PAN) fiber (3000 count filaments).

The section heated to 1000 degrees C., had a weight loss of 46.5%, a 5 cm length of the deknit tow had a resistance of 48 ohms.

A 2.5×5 cm section of the sock after heating to 1500 degrees C. had before deknitting a resistance of 1.9 ohms and a stretched section of a deknit tow 2.5 cm long, had a resistance of 2.9 ohms.

C. Following the procedure of Part B, similar oxidation stabilizing acrylonitrile (6000 count filaments) tow knit fabrics which were heated to 372 degrees C. and 564 degrees C. respectively; the portion which had been heat treated to 564 degrees C. lost 31% of its weight and had a resistance, with respect to the cloth, of 1×106 ohm per square and a tow drawn from the fabric had a resistance of 400 ohms per cm;

The material which had been heat treated to 372 degrees C. lost about 31% of its original weight and had an electrical resistance of greater than about 10×1012 ohm per square.

The experiments show that it is evident that the nature of the perecursor material, the oxidation stabilized polyacrylonitrile, provides properties which the rayon precursor does not provide when subjected to the same treatment.

EXAMPLE 13

The non-flammability of the fibers of the invention has been determined following the test procedure set forth in 14 CFR 25.853(b) which is herewith incorporated by reference. The test was performed as follows:

A minimum of three 1"×6"×6" (2.54 cm×15.24cm×15.24 cm) specimens were conditioned by maintaining the specimens in a conditioning room maintained at 70 degrees C.±5% relative humidity for 24 hours preceding the test.

Each specimen was supported vertically and exposed to a Bunsen or Turill burner with a nominal I.D. tube of 11/2 inches (3.8cm) in height. The minimum flame temperature measured by a calibrated thermocouple pyrometer in the center of the flame was 1550 degrees F. The lower edge of the specimen was ¾ inch (1.91cm) above the top edge of the burner. The flame was applied to the cluster line of the lower edge of the specimens for 12 seconds and then removed.

Pursuant to the test, the material was self-extinguishing. The average burn length did not exceed 8 inches (20.32 cm), the average after flame did not exceed 15 seconds and no drippings were observed.

Surprisingly, the fibers of the invention all had a LOI of greater than 40.

EXAMPLE 14

In order to determine the amount of fiber retention of an acrylic fiber, the heat treated fibres comprising a PANOX precursor fiber was analyzed for their nitrogen carbon and hydrogen content. The results were as follows.

| Sample # | % C | % H | % N | Temp. degrees C. | Time at Temp. (min) |
|---|---|---|---|---|---|
| 1 | 69.1 | 2.1 | 20.2 | 450 | 60 |
| 2 | 68.3 | 1.7 | 18.8 | 504 | 120 |
| 3 | 66.8 | 2.2 | 19.4 | 450 | 25 |
| 4 | 69.1 | 1.9 | 18.9 | 550 | 8 |
| 5 | 69.6 | 1.5 | 18.8 | 550 | 60 |
| 6 | 69.7 | 1.6 | 18.1 | 650 | 8 |
| 7 | 68.6 | 1.3 | 17.4 | 650 | 8 |
| 8 | 74.0 | 0.9 | 17.9 | 670 | 60 |
| 9 | 73.5 | 1.0 | 17.8 | 670 | 60 |
| 10 | 72.3 | 1.3 | 18.5 | 672 | 30 |
| 11 | 76.0 | 0.9 | 16.6 | 750 | 30 |
| 12 | 75.3 | 0.9 | 16.1 | 750 | 90 |
| 13 | 73.0 | 1.1 | 17.8 | 750 | 12 |
| 14 | 71.2 | 0.8 | 16.0 | 750 | 12 |
| 15 | 75.3 | 0.8 | 16.9 | 770 | 60 |
| 16 | 79.0 | 0.7 | 15.0 | 870 | 60 |
| OPF | 58.1 | 3.8 | 19.6 | | |
| OPF | 58.5 | 3.6 | 19.7 | | |

What is claimed is:

1. A non-flammable non-linear resilient permanently heat set elongatable carbonaceous fiber having a reversible deflection ratio of greater than 1.2:1 and an aspect ratio greater than 10:1.

2. The carbonaceous fiber of claim 1 wherein said fiber is derived form an oxidation stabilized acrylic fiber.

3. The carbonaceous fiber of claim 2 wherein said acrylic fiber is selected from the group consisting of homopolymers, copolymers and terpolymers of acrylonitrile.

4. The fiber of claim 1, wherein said fiber has a sinusoidal configuration.

5. The fiber of claim 1, wherein said fiber has a coil-like configuration.

6. The fiber of claim 1 wherein said fiber has a resistance of greater than $10^7$ ohms per inch when measured on a 6K tow formed from precursor fibers having a diameter of 10 to 12 microns and is non-electrically conductive.

7. The fiber of claim 6 wherein said fiber has no antistatic characteristics.

8. The fiber of claim 7 wherein said fiber has a bulk density of less than about 32 $kg/m^3$.

9. The fiber of claim 1 wherein said fiber has a resistance of about $10^4$ to $10^7$ ohms per inch when measured on a 6K tow of fibers formed from precursor fibers having a diameter of 10 to 12 microns and is electrically conductive.

10. The fiber of claim 9, wherein said fiber has a carbon content of less than 85%.

11. The fiber of claim 9, wherein said fiber has a carbon content of at least 85%.

12. The fiber of claim 1, wherein said fiber is derived from stabilized acrylic fibers and said carbonaceous fiber has a percent nitrogen content of about 10–35%.

13. The fiber of claim 1, wherein the carbon content is at least 65%.

14. The fiber of claim 1, wherein the limited oxygen index value of said fiber is greater than 40.

15. The fiber of claim 1, wherein said carbonaceous fiber has a nitrogen content of about 20 to 25%.

16. A non-linear elongatable structure derived from an oxidation stabilized fiber precursor material, said precursor fiber being capable of producing on heat treatment of fiber having a diameter of from 4 to 20 microns, said structure also have a reversible deflection of greater than about 1.2:1 and an aspect ratio of greater than 10:1.

17. The structure of claim 16, wherein said reversible deflection ratio is greater than 2.

18. The structure of claim 16, wherein said fiber obtains heat treatment thereof have a specific resistivity of less than $10^{10}$ ohm-cm, a density of less than 2.5 gm/cc, a Young's modulus of form 6.9 GPa to 380 GPa, and a surface area of less than 15 $m^2/gm$ under an inert atmosphere.

19. The structure of claim 16 having a specific resistivity of less than $10^{10}$ ohm-cm, a density of less than 2.5 gm/cc, a Young's modulus of from 6.9 GPa to 380 GPa, and a surface area of less than 15 $m^2/gm$ resulting from a stabilized fiber which has been heat treated above 1000 degrees C. in a relaxed coil-like or sinusoidal structure under an inert atmosphere for electrical conductivity or specific resistance.

20. A wool-like fluff comprising a multiplicity of the carbonized fibers of claim 1, said fibers having a specific resistivity of less than $10^{10}$ ohm-cm and a resistance of less than 75 ohms at a probe distance of less than 60 cm when measured across the wool-like fluff.

21. A method of forming a non-flammable non-linear carbonized fiber with reversible deflection, comprising the steps of spinning a fiber from a carbonaceous precursor material, stabilizing the precursor fiber by oxidation at a temperature of from 200 degrees to 250 degrees C., imparting a coil-like or sinusoidal configuration to the stabilized fiber, and thereafter heating the fiber in a relaxed condition in a non-oxidizing atmosphere to a temperature of from 150 degrees to about 1500 degrees C to impart a set coil-like or sinusoidal configuration to the fiber.

22. The method of claim 21, including the step of assembling the stabilized fiber into a fiber tow, imparting said coil-like or sinusoidal configuration to the stabilized fiber tow, and heating the fiber tow in said relaxed condition to a temperature of from 250 degrees to 450 degrees C. to impart said set configuration to the fiber tow.

23. The method of claim 22, including the step of heating the permanently set and linearly deformed fiber tow in a non-oxidating atmosphere in a relaxed condition at a temperature of from 450 degrees to 550 degrees C.

24. The method of claim 22, including the step of imparting said deformed configuration to the stabilized fiber tow by winding the tow around a cylindrical mandrel to form a spirally shaped, permanently set fiber tow, by heating the wound fiber tow to a temperature of from 200 degrees to 275 degrees C. in a non-oxidizing atmosphere, removing the fiber tow from the cylindrical mandrel, and heating the spirally shaped fiber tow, in a relaxed condition, and in an inert atmosphere, to a temperature of from 525 degrees to 1000 degrees C. to form a carbonized fiber tow having fibers with spring-like reversible deflection.

25. The method of claim 22, including the step of imparting said deformed configuration to the stabilized fiber tow by knitting the tow into a cloth and then heating the cloth to a temperature of from 250 degrees to 450 degrees C., deknitting the cloth, and mechanically treating the deknitted fiber tow to form a wool-like fluff.

26. The method of claim 25, including the step of heating the wool-like fluff to a temperature of reference about 1000 degrees C. and 3000 degrees C. to render the fibers in the fluff electrically conductive.

27. The method of claim 22, including the step of heating the electrically conductive fiber tow to a temperature of greater than 1000 degrees C. to render the fibers more highly electrically conductive, and incorporating the electrically conductive fibers into a synthetic resinous material.

* * * * *

UNITED STATES PATENT AND TRADEMARK OFFICE

CERTIFICATE OF CORRECTION

PATENT NO. : 4,837,076

DATED : June 6, 1989

INVENTOR(S) : Francis P. McCullough, Jr. and David M. Hall

It is certified that error appears in the above-identified patent and that said Letters Patent is hereby corrected as shown below:

Column 3, Line 2; change "kinds" to --kinks--.

Column 3, Line 42; change "where" to --when--.

Column 6, Line 34; change "preferred" to --referred".

Column 8, Line 39; delete "the" between "of" and "fiber".

Column 9, Line 40; change "than" to --then--.

Column 12, Line 35; change "broken" to --broke--.

Column 13, Line 19; change "broken" to --broke--.

Column 13, Line 25; change "two" to --tow--.

Column 14, Line 42; change "fibres" to --fibers--.

Column 14, Line 43; change "was" to --were--.

Column 15, Line 44; change "of" (first occurrence) to --a--.

UNITED STATES PATENT AND TRADEMARK OFFICE

CERTIFICATE OF CORRECTION

PATENT NO. : 4,837,076

DATED : June 6, 1989

INVENTOR(S) : Francis P. McCullough, Jr. and David M. Hall

It is certified that error appears in the above-identified patent and that said Letters Patent is hereby corrected as shown below:

Column 15, Line 53; change "form" to --from--.

Signed and Sealed this

Thirtieth Day of June, 1992

*Attest:*

DOUGLAS B. COMER

*Attesting Officer*

*Acting Commissioner of Patents and Trademarks*